US006145960A

United States Patent [19]

Kanda et al.

[11] Patent Number: 6,145,960

[45] Date of Patent: Nov. 14, 2000

[54] INK JET RECORDING APPARATUS AND INK JET RECORDING METHOD

[75] Inventors: Hidehiko Kanda, Kawasaki; Toshiharu Inui, Yokohama; Daigoro Kanematsu, Kawasaki, all of Japan

[73] Assignee: Canon Kabushiki Kaisha, Tokyo, Japan

[21] Appl. No.: 09/188,316

[22] Filed: Nov. 10, 1998

[30] Foreign Application Priority Data

Nov. 14, 1997 [JP] Japan ..... 9-314056

[51] Int. Cl.[7] ..... B41J 2/145; B41J 2/15; B41J 29/38

[52] U.S. Cl. ..... 347/41; 347/9; 347/16

[58] Field of Search ..... 347/41, 9, 16, 347/12, 40, 105; 400/555

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 5,608,439 | 3/1997 | Arbeiter et al. | 347/102 |
| 5,779,377 | 7/1998 | Kumai et al. | 400/555 |

FOREIGN PATENT DOCUMENTS

| | | |
|---|---|---|
| 54-56847 | 4/1979 | Japan . |
| 59-123670 | 7/1984 | Japan . |
| 59-138461 | 8/1984 | Japan . |
| 60-71260 | 4/1985 | Japan . |
| 60-107975 | 6/1985 | Japan . |

*Primary Examiner*—Thinh Nguyen

*Attorney, Agent, or Firm*—Fitzpatrick, Cella, Harper & Scinto

[57] ABSTRACT

An ink jet recording apparatus which carries out, in a decimated multipass print mode, paper transfer by an extra amount (2.5 μm) beyond a standard paper transfer amount corresponding to a quarter of the total number of nozzles in the nozzle arrangement of a recording head. This can displace dots formed in subsequent scannings from dots formed in previous scannings by amounts of 2.5 μm, 5 μm, 7.5 μm and 10 μm, and reduce the overlap of the dots at boundary regions in the decimated multipass print mode. In a one pass print mode, the paper transfer amount per scanning is set less than the sum total of the four paper transfer amounts of the decimated multipass print mode so that dot overlaps take place as countermeasures against paper transfer errors. This makes it possible to achieve high quality image recording by preventing both the white bandings at the boundary regions in the one pass print mode that prints one unit area by one scanning, and black bandings at boundary regions in the decimated multipass print mode that prints the one unit area by a plurality of scannings, thereby achieving high quality recording.

16 Claims, 14 Drawing Sheets

INK JET RECORDING APPARATUS AND INK JET RECORDING METHOD

This application is based on Patent Application No. 314056/1997 filed on Nov. 14, 1997 in Japan, the content of which is incorporated hereinto by reference.

BACKGROUND OF THE INVENTION

1. Field of the Invention

The present invention relates to an ink jet recording apparatus and ink jet recording method that carry out recording by discharging ink to a recording medium, and more particularly to reduction of density unevenness such as so-called bandings at the boundaries between recording scanning areas.

2. Description of Related Art

Recording apparatuses employed as print output means of pictures in printers, copying machines and facsimile machines, or those used as print output equipment of complex electronic machines or workstations incorporating a computer or word processor are constructed such that they record pictures on a recording material (also called recording medium hereinafter) such as paper or a plastic sheet in response to image information (including all output information including text information). Such recording apparatuses can be divided into ink jet printing systems, wire matrix printing systems, thermal printing systems, laser beam printing systems and the like. Among these, the recording apparatus based on the ink jet printing (called ink jet recording apparatus hereinafter) carries out recording by discharging ink onto a recording material from a recording means including recording heads, and has such advantages over the other recording systems that it can easily implement high resolution, high speed printing, and is quiet and inexpensive. On the other hand, to meet the strong demand for color output such as color pictures, many types of color ink jet recording apparatuses have been developed recently.

It is common for such an ink jet recording apparatus to employ a recording head that integrates a plurality of ink discharge orifices and ink passages as a recording unit (called multi-head hereinafter) that integrates multiple recording elements arranged, and to comprise a plurality of multi-heads to deal with the color printing.

FIG. 1 is a schematic perspective view showing a major portion of a system for carrying out recording (also called printing hereinafter) on paper using the multi-head. In FIG. 1, each reference numeral 101 designates an ink jet cartridge. The ink jet cartridges 101 include ink tanks for holding four color inks, black, cyan, magenta and yellow, and a multi-head 102 corresponding to the inks. FIG. 2 is a schematic diagram illustrating discharge orifices (also called nozzles hereinafter) disposed in the multi-head 102, which are seen from the z direction in FIG. 1. In FIG. 2, the reference numeral 201 designates n nozzles arranged at a pixel density of N per inch (N dpi) in the multi-head 102.

Returning to FIG. 1, the reference numeral 103 designates a sheet transfer roller that rotates in the direction indicated by an arrow with holding printing paper P between it and an auxiliary roller 104 to transport the printing paper P in the y direction. The reference numeral 105 designates a pair of feed rollers for feeding the printing paper. The pair of rollers 105 also rotates with holding the printing paper P as the rollers 103 and 104, and their rotation speed is set less than that of the sheet transfer roller 103 to exert tension on the printing paper. The reference numeral 106 designates a carriage for supporting the ink jet cartridges 101 for causing them to scan and print. The carriage 106 stays at a home position h denoted by broken lines in this figure while it is free from printing or it is carrying out recovery processing or the like of the multi-head 102.

The carriage 106 which is placed at the home position h before the start of printing moves in the x direction when a print start command is issued, and carries out printing on the paper with a height of n/N using the n nozzles 201 disposed on the multi-head 102 at a density of N per inch. Completing printing to the opposite end of the paper, the carriage returns to the home position, and moves again in the x direction to continue printing. Before starting the second printing after the end of the first printing, the sheet transfer roller 103 rotates in the arrow direction so that the paper is transported in the y direction by an amount of n/N inch. Thus, by repeating such printing by the multi-head 102 and paper transport by an amount of n/N inch per main scanning of the carriage 106, printing of one page, for example, can be completed. Such a printing process is called one pass print mode below.

The one pass print mode is most suitable for printing text or graphical images at a high speed as with a monochromatic printer. Its paper transfer system operation, however, sometimes involves a slight error in general. FIGS. 3A to 3C show examples of such paper transfer errors, in which FIG. 3A illustrates an ideal paper transfer, whereas FIG. 3B illustrates a space of a height s at a discontinuous joint between dots of Kth and (K+1)th scannings, and FIG. 3C illustrates an overlap of a height s. The space of the height s due to the paper transfer error brings about a white banding of the height s in the main scanning direction in a printed picture, and the picture is considered as a defective one. In contrast with this, since the joint is kept continuous in the overlap case of the height s, it is often unperceived, and the picture is not handled as a defective picture. Thus, to compensate for the paper transfer error visually, the paper transfer amount of a conventional paper transfer system is sometimes set less than a standard value so that the joint is kept continuous.

On the other hand, to print a graphical image, various recording characteristics such as uniformity of color development, gray levels and uniformity of density are required. In particular, with regard to the uniformity of the density, it is known that slight difference in individual nozzles, which are produced in a multi-head fabrication process, bring about difference in the volume or direction of ink discharged from the nozzles, and this causes density unevenness of the printed image, thereby degrading its quality.

An example of this will be described with reference to FIGS. 4A to 4C and FIGS. 5A to 5C. In FIG. 4A, the reference numeral 41 designates a multi-head with eight nozzles 42. Each reference numeral 43 designates an ink droplet discharged from one of the nozzles 42. Ideally, it is desirable that the ink be discharged in the same direction in about the same volume as shown in this figure, which would bring about uniform dots on a sheet as illustrated in FIG. 4B, and produce an image without density unevenness as illustrated in FIG. 4C.

In reality, however, the nozzles have errors as described above, and hence if printing is carried out in the same manner as shown in FIGS. 4A to 4C, the volume and direction of the ink droplets discharged from the nozzles become somewhat random as illustrated in FIG. 5A. As a result, dots are formed on a sheet as illustrated in FIG. 5B. In this example, there arise in the main scanning direction of the head cyclic blanks that cannot satisfy the area factor of 100%, or black bandings due to unsuitable overlaps of dots, or white bandings as illustrated in the center of FIG. 5B. The image consisting of such dots has a density distribution as illustrated in FIG. 5C in the nozzle arrangement direction, and hence a density unevenness is perceived.

As countermeasures against such density unevenness or bandings, Japanese patent application laid-open No. 60-107975/1985, for example, discloses the following method in a monochromatic ink jet recording apparatus. The method will be described briefly with reference to FIGS. 6A to 6C and 7A to 7C.

Although this method carries out three scannings of the multi-head 41 as illustrated in FIG. 6A to complete the printed area as shown in FIG. 6B, half of the printed area corresponding to four nozzles is completed in two scannings (also called passes hereinafter). More specifically, the eight nozzles of the multi-head 41 are divided into two groups consisting of the upper four nozzles and lower four nozzles, and dots that are printed by one group of the nozzles (namely, four nozzles) in one main scanning produce from given image data an approximately half decimated or thinned out image with a predetermined pattern. Then, the second scanning completes the area corresponding to the four remaining nozzles by carrying out the printing in accordance with the prescribed patterns. Such a print mode is referred to as a decimated multipass print mode hereinafter.

Using such a print mode will halve the effect of the characteristics of each nozzle on the printed image in the scanning areas, even if the same multi-head as shown in FIGS. 5A to 5C is used. Thus, the printed image becomes as shown in FIG. 6B, in which the black bandings or white bandings are less conspicuous than those in FIG. 5B. As a result, the density unevenness is reduced considerably as shown in FIG. 6C as compared with that of FIG. 5C.

In such a recording scheme, the image data is usually divided into the first and second scannings in accordance with predetermined arrangements that are complementary to each other. It is most common that the image data arrangements (decimated pattern) are staggered check arrangements of respective pixels in rows and columns as shown in FIGS. 7A to 7C. Accordingly, to record a unit printed area (an area corresponding to the four nozzles), the printing is completed by the first and second scannings that carry out printing in a staggered check arrangement and in a counter-staggered check arrangement, respectively.

FIGS. 7A, 7B and 7C illustrate a process in which an area is recorded using the staggered check and counter-staggered check patterns.

In FIGS. 7A to 7C, the first scanning carries out the recording of the staggered check pattern using the lower four nozzles (FIG. 7A). After incrementing the paper by an amount of four pixels (half the height of the head), the second scanning carries out recording in the counter-staggered check pattern using all the eight nozzles (FIG. 7B). After incrementing the paper by an amount of four pixels (half the height of the head), the third scanning carries out recording in the staggered check pattern again (FIG. 7C). Thus, alternating the staggered and counter-staggered check patterns after incrementing the paper by an amount of four pixels can complete the four-pixel high recorded area for each scanning.

As described above, high quality image with little density unevenness can be obtained by completing the printing using two different nozzles in the same area.

Thus, when outputting monochromatic texts or graphical images at a high speed, the one pass print mode is executed in which the paper transfer amount is set less than a standard value, whereas when outputting high quality color graphical images, the decimated multipass print mode is carried out to improve the problem of density unevenness at joints between the scanning areas or in other areas.

However, increasing the pixel density and gray levels of recording to produce picture-like high quality color graphical image, for example, will make the black bandings, which are rather visually inconspicuous conventionally, increasingly noticeable at the scanning boundaries in the decimated multipass print mode, thereby degrading the image quality.

One of the reasons for this is that although printing of an image area other than boundaries of each scanning area is completed in a time period corresponding to the number of scannings necessary for completing the image, an area adjacent to a boundary (also called boundary region hereinafter) is affected by the printing of the first scanning of the next scanning area, so that it takes extra time corresponding one scanning to finally determine the density at the boundary region. Generally, dots that constitute individual pixels are formed with sizes greater than the size of the pixels, and hence the dots of the adjacent pixels overlap in part on each other. Accordingly, with regard to the pixels in the boundary regions, their density is determined after the printing of the next scanning area is completed.

In the foregoing case, however, the dots in the boundary region between the two adjacent scanning areas are formed on a recording sheet with a time delay corresponding to one scanning, and this brings about a black banding resulting from density unevenness due to the difference of penetration and fixation of ink that produces dots on the recording medium.

FIGS. 8A to 8D are schematic diagrams illustrating states of landing and fixation of ink on a recording sheet, which indicate that the fixation degree of the previously landing ink affects the fixation of the next landing ink.

Although the previously landing ink brings about a state as denoted by black portions in these figures when it is sufficiently fixed, if its fixation is insufficient, the subsequently landing ink may penetrate in part under the previously landed ink as indicated by shadowed portions in these figures. If such a dot overlap due to the time delay takes place in the boundary region, it can appear as a banding distinct from the remaining portion. In particular, since such overlaps between the adjacent dots take place frequently in solidly printed areas with high printing duty, they will bring about increasing black bandings due to conspicuous density unevenness. Furthermore, setting the paper transfer amount less than the standard value to establish compatibility with the one pass print mode will cause more overlaps of the adjacent dots, resulting in more noticeable black bandings.

SUMMARY OF THE INVENTION

The present invention is implemented to solve the foregoing problems. Therefore, it is an object of the present invention to provide an ink jet recording apparatus capable of achieving quality image recording by preventing both the white bandings due to paper transfer error at the boundary regions in the one pass print mode, and black bandings due to density unevenness at boundary regions in the decimated multipass print mode.

An ink jet recording apparatus according to the present invention, which carries out recording using a recording head with a plurality of ink discharge orifices provided at predetermined intervals for recording on a recording medium, is constructed such that it comprises: scanning means for scanning the recording head in a main scanning direction, in which recording is carried out on a unit area on the recording medium, the unit area corresponding to the plurality of ink discharge orifices; transfer means for transporting the recording medium in a sub scanning direction in contrast to the main scanning direction; and recording control means for recording on the one unit area based on recording data by driving the recording head, during the time in which the recording head is being driven in the main scanning direction, wherein the recording control means increases a transfer amount of transporting the recording medium in the sub scanning direction by an amount less than that of the predetermined interval as compared with a height of subdivided areas that constitute the unit area on the recording medium in a multipass print mode that recording is performed based on recording data on the subdivided areas of the recording medium in a plurality of scannings of the recording head in the main scanning direction.

In the ink jet recording apparatus as constructed above, the recording control means reduces, in a one-pass print mode that recording is performed based on the recording data on the unit area on the recording medium in a single scanning of the recording head in the main scanning direction, a transfer amount of transporting the recording medium in the sub scanning direction by an amount less than that of the predetermined interval as compared with a height of the unit area in the transporting direction, whereas the recording control means comprises, as the multipass print mode, decimated multipass print mode for recording on the plurality of subdivided areas using decimated patterns that are complementary to each other, and in the decimated multipass print mode, the recording medium is transported in the sub scanning direction by an amount of $[\{(n/m)/N\}+b]$ inch, where N is a density of the plurality of discharge orifices of the recording head per inch, and n is a number of the discharge orifices, recording height on the recording medium in a single scanning is about n/N inch, m is a number of the subdivided areas in the unit area, and b is a value in a range of $0 \leqq b < 1/(N \times m)$.

Further, the transfer means is constructed such that a recording medium transfer roller has a diameter greater than a standard size, and in the decimated multipass print mode, the recording control means drives the transfer roller just as in the standard driving method, whereas the recording control means performs the decimated multipass print mode by transporting the recording medium in the sub scanning direction alternately by an amount of $[[\{(n/m)+0.5\}/N]+b]$ inch and $[[\{(n/m)-0.5\}/N]+b]$ inch in a print mode that carries out printing at a density of $(N \times 2)$ dots per inch, where b is a value in a range of $0 \leqq b < 1/(N \times 2 \times m)$.

On the other hand, an ink jet recording method according to the present invention that records data on a unit area on a recording medium, which corresponds to a plurality of ink discharge orifices provided at predetermined intervals in the recording head thereof, on the basis of recorded data by driving a recording head, during the time in which the recording head is being driven in the main scanning direction, comprises the steps of: reducing, in a one-pass print mode that records data on the basis of recorded data on the unit area on the recording medium in a single scanning in the main scanning direction of the recording head, a transfer amount of incrementing the recording medium by an amount less than that of the predetermined interval in the sub scanning direction as compared with a height of the unit area in the sub scanning direction; and increasing, in a decimated multipass print mode as the multipass print mode that records data on the basis of recorded data on the subdivided areas of the recording medium in a plurality of scannings of the recording head in the main scanning direction, a transfer amount of transporting the recording medium by an amount less than that of the predetermined interval in the sub scanning direction as compared with a height of subdivided areas that constitute the unit area on the recording medium.

The ink jet recording method as mentioned above includes the steps of shifting, in the one-pass print mode, the recording medium in the sub scanning direction by an amount of $[(n/N)+a]$ inch to record based on the recording data on the unit area, where a is a value in a range of $-1/N < a \leqq 0$, and shifting the recording medium, in the decimated multipass print mode, in the sub scanning direction by an amount of $[\{(n/m)/N\}+b]$ inch, where N is a density of the plurality of discharge orifices of the recording head per inch, and n is a number of the discharge orifices, recording height on the recording medium in a single scanning is about n/N inch, m is a number of subdivided areas in the unit area, and b is a value in a range of $0 \leqq b < 1/(N \times m)$.

According to the present invention, in the multipass print mode that carries out recording of a unit area in a plurality of scannings using different discharge orifices, the transport amount of the recording medium in the plurality of scannings is made greater than the height of the unit area in the transport direction. This makes it possible to reduce the superimposition of the dots at the boundaries between the unit areas, and hence to reduce the density unevenness due to the scannings of the areas carried out with a time delay.

On the other hand, in the one pass print mode that records by one scanning an area corresponding to the plurality of discharge orifices of the recording head, the transfer amount is made less than the height of that area. This makes it possible for the dot superimposition to be produced in spite of errors in the transfer amount, and hence to prevent spaces from taking place between the dots of the areas.

As a result, quality image recording can be achieved by preventing both the white bandings due to the paper transport error and the black bandings due to the density unevenness at the boundaries in the decimated multipass print mode.

The above and other objects, effects, features and advantages of the present invention will become more apparent from the following description of the embodiments thereof taken in conjunction with the accompanying drawings.

DETAILED DESCRIPTION OF PREFERRED EMBODIMENTS

The invention will now be described with reference to the accompanying drawings.

Figure 9:
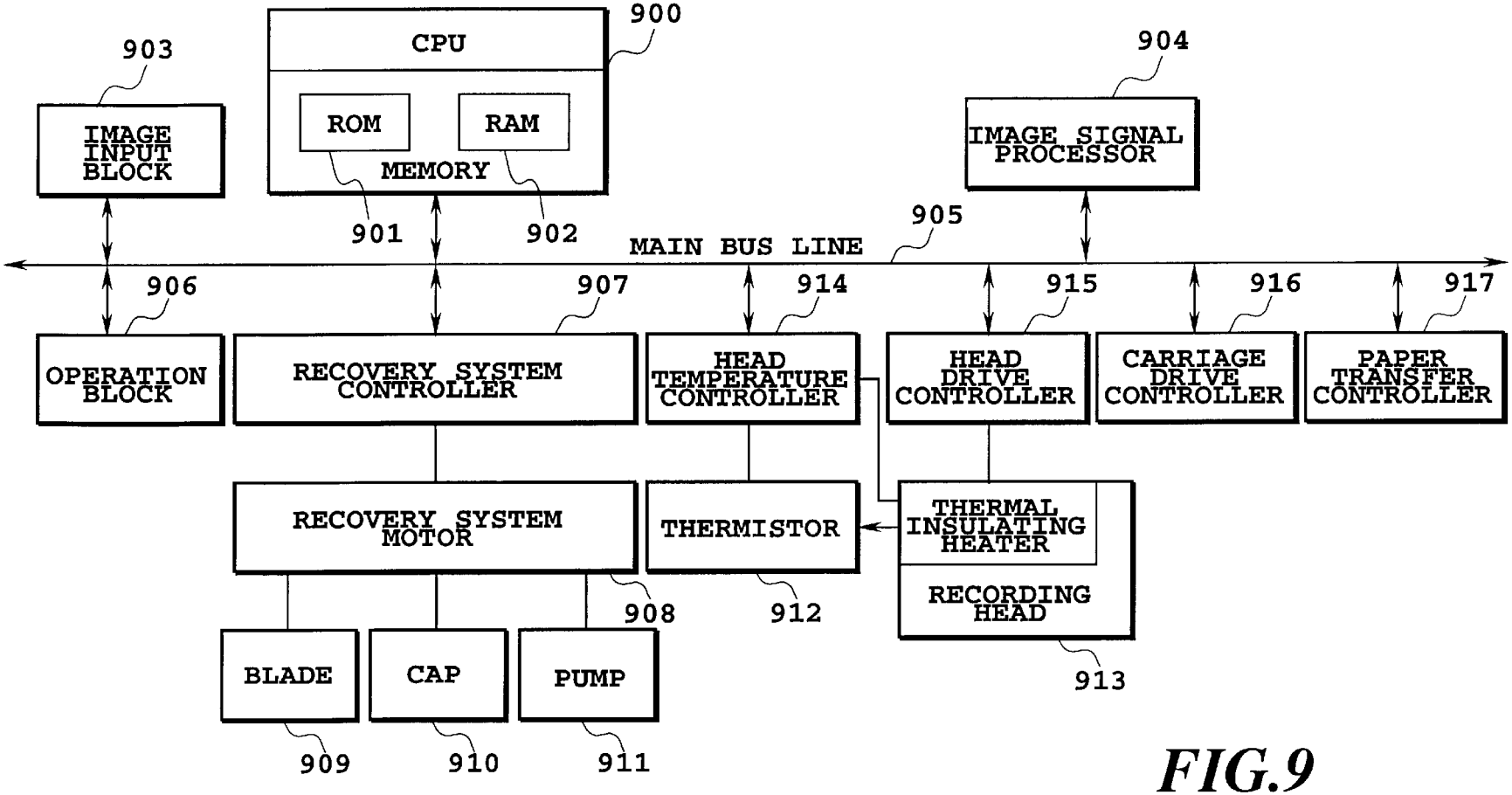
FIG. 9 is a block diagram showing a control system of an ink jet recording apparatus associated with embodiments in accordance with the present invention.
Figures 10A, 10B, 10C, 10D:
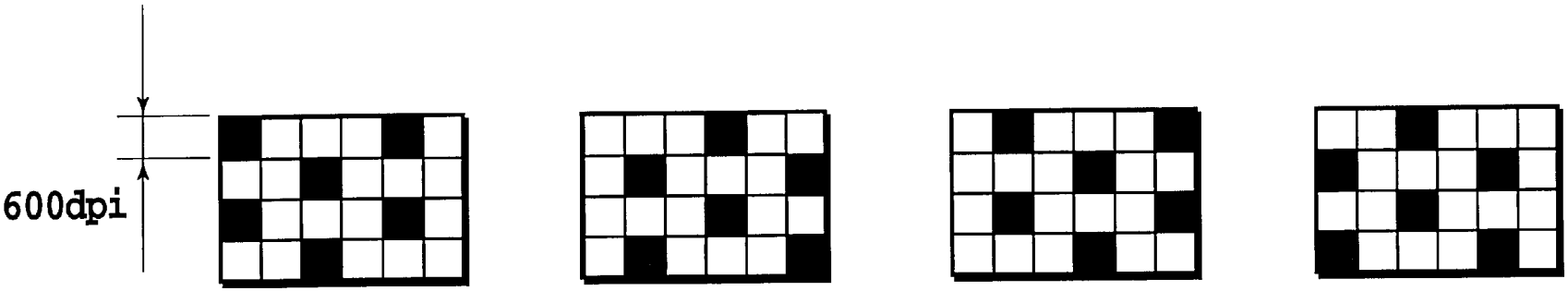
FIGS. 10A to 10D are diagrams schematically illustrating decimated patterns used in the first and second embodiments in accordance with the present invention.

FIG. 9 is a block diagram showing an embodiment of an ink jet recording apparatus in accordance with the present invention. The mechanical structure of the present embodiment of the ink jet recording apparatus is the same as that shown in FIG. 1.

In FIG. 9, a CPU 900 controls various portions of the apparatus through a main bus line 905 and carries out data processings. Specifically, the CPU 900 controls, in accordance with programs stored in a ROM 901, the data processings described in connection with FIGS. 10A to 10D and thereafter, and the head driving and carriage driving through the following portions. A RAM 902 is used as a work area of the data processings or the like by the CPU 900, and there is provided a hard disk or the like as a storage. An image input block 903 includes an interface with a host system, and temporarily holds an input image sent from the host system. An image signal processor 904 carries out, apart from color conversion and binarization, data processings shown in FIGS. 10A to 10D and thereafter.

An operation block 906 comprises a keyboard and the like, enabling an operator to enter control input. A recovery system controller 907 controls, in accordance with a recovery program stored in the RAM 902, recovery operation such as preliminary discharge. More specifically, a recovery system motor 908 drives, besides a recording head 913, a blade 909, cap 910 and pump 911 which are opposed to and spaced apart from the recording head 913. A head drive controller 915 controls driving of the ink discharging electrothermal converting elements of the recording head 913, and has the recording head 913 carry out preliminary discharge or ink discharge for recording. A carriage drive controller 916 and paper transfer controller 917 controls, in accordance with programs, carriage movement and paper transport.

On a substrate, on which ink discharging electrothermal converting elements of the recording head 913 are mounted, an insulating heater is disposed for heating and regulating the ink temperature in the recording head at a desired setting temperature. A thermistor 912 is also mounted on the substrate for measuring the effective ink temperature in the recording head. It can be placed outside the substrate or at a location close to the recording head.

Various embodiments in accordance with the present invention based on the foregoing system structure will now be described.

First Embodiments

The recording head of a first embodiment in accordance with the present invention has n=256 discharge orifices (256 nozzles) at a density of N=600 per inch (600 dpi), so that a recording height per scanning becomes (n/N)=(256/600) inch≈10.84mm. On the other hand, the resolution per pulse of a motor for driving a sheet transfer roller for incrementing a recording medium is 1200 dots per inch (1200 dpi) in terms of the transfer distance, which is equivalent to double the pixel density, and equals about 20 μm. As described before, in an ideal case in which there arises no error in the scanning displacement in the sub scanning direction associated with paper transport, the recording medium should be shifted in the sub scanning direction by 10.84 mm equal to the height per main scanning, in one pass print mode. In contrast, in a decimated multipass print mode, in which the nozzle column is divided by m (=4) and an image is completed in m (=4) scannings, the recording medium should be shifted 2.71 mm per scanning in the sub scanning direction, which is nearly equal to (n/m)/N=(64/600) inch, corresponding to 64 nozzle height (64×nozzle pitch) or the divided-by-4 value of (n/m)=(256/4).

In reality, however, there arises some error in the transfer distance as described before. Accordingly, it is necessary for the one pass print mode to superimpose in part the printed regions in respective sub scannings to prevent a space from taking place between the boundaries of sub scannings. On the other hand, in the decimated multipass print mode, superimposing the printed regions in sub scannings will cause a black banding at the boundaries of the sub scannings.

To prevent the black bandings in the decimated multipass print mode, the present embodiment increases the diameter of the sheet transfer roller as compared with a standard one, so that the paper transfer is increased by 10 μm from the transfer distance of 10.84 mm corresponding to the recording height of one main scanning. This can reduce the superimposition of dots at the boundaries of individual scannings as compared with that in the standard case, even if the transfer error takes place. In the decimated multipass print mode of the present embodiment, which completes the image in four scannings, the transfer is increased by 10 μm/4=2.5 μm per scanning from that of the standard case.

Figure 11:
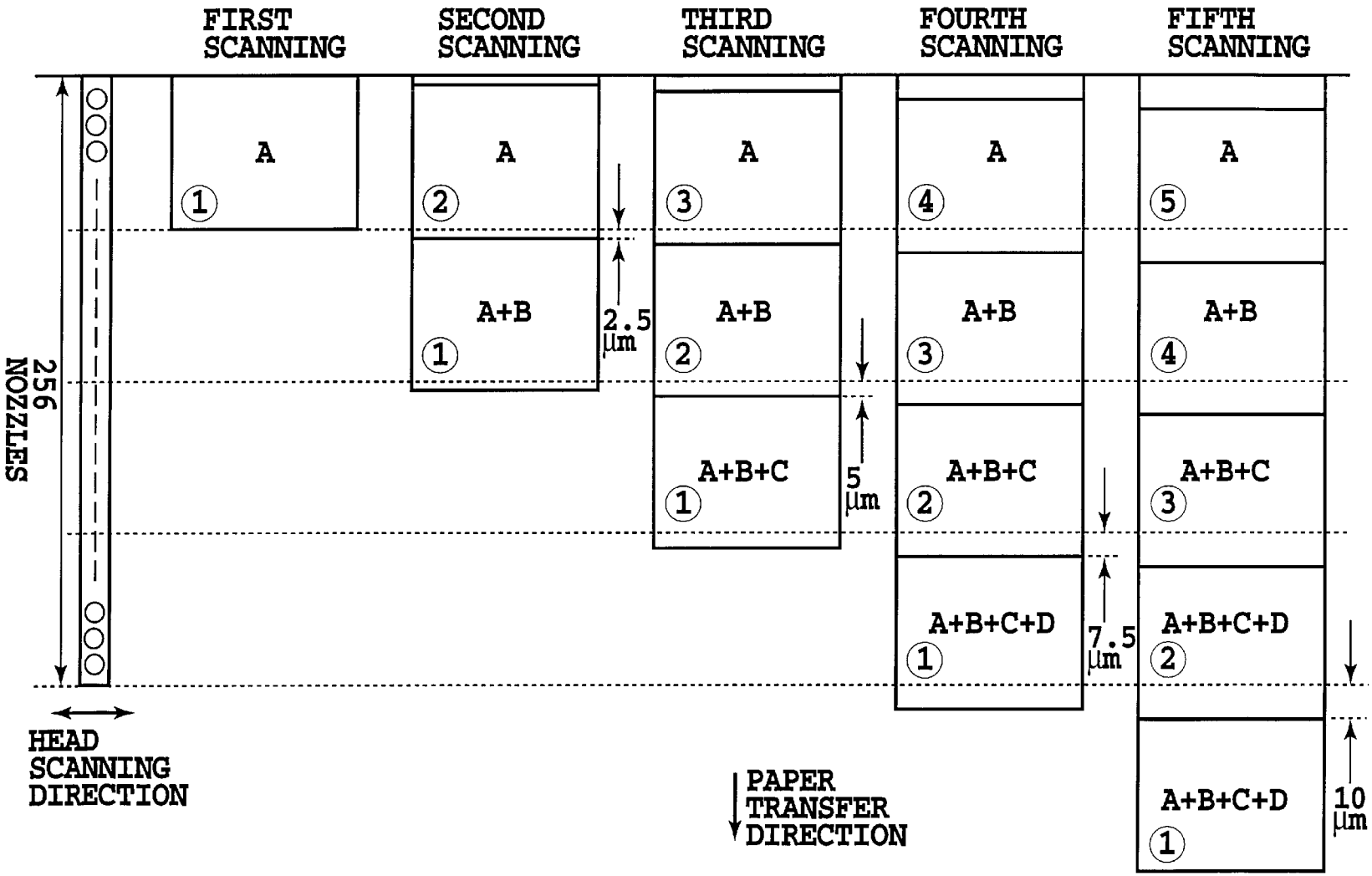
FIG. 11 is a diagram illustrating a recording method in the decimated multipass print mode in the first embodiment in accordance with the present invention.

Referring to FIGS. 10 and 11, a recording method of the present embodiment in the decimated multipass print mode will be described.

FIGS. 10A to 10D are diagrams showing four decimated patterns that are complementary to each other. First, in the first scanning as shown in FIG. 11, printing is carried out using the decimated pattern A as shown in FIGS. 10A to 10D using 64 nozzles from the first to 64th nozzles of the 256 nozzles.

Subsequently, the sheet transfer roller is driven to transfer the recording medium in the sub scanning direction by an amount of 64 nozzles×2=128 pulses. The transfer distance in this case is (64/600) inch≈2.71 mm plus 2.5 μm due to the increase in the roller diameter. In the second scanning, the scanning area [1] is printed using the decimated pattern B as shown in FIGS. 10A to 10D, and the scanning area [2] is printed using the decimated pattern A as shown in FIGS. 10A to 10D. In the course of this, in the boundary between the scanning areas [1] and [2], the distance between dots recorded in the decimated pattern A in the first scanning and in the second scanning is increased by 2.5 μm as compared with the standard case.

Afterward, the recording medium is transported by the amount of 128 pulses as in the previous step, and in the third scanning, the scanning area [1] is printed in the decimated pattern C as shown in FIGS. 10A to 10D, the scanning area [2] is printed in the decimated pattern B, and the scanning area [3] is printed in the decimated pattern A. In the course of this, in the boundary between the scanning areas [1] and [2], the distance between dots recorded in the decimated pattern A in the first scanning and dots recorded in the decimated pattern B in the third scanning is increased by 5.0 μm as compared with the standard case. Likewise, the distance between dots recorded in the decimated pattern B in the third scanning and in the second scanning is increased by 2.5 μm as compared with the standard case.

Likewise, the recording medium is transported by the amount of 128 pulses, and in the fourth scanning, the scanning area [1] is completed in the decimated pattern D as shown in FIGS. 10A to 10D, the scanning area [2] is printed in the decimated pattern C, the scanning area [3] is printed in the decimated pattern B, and the scanning area [4] is printed in the decimated pattern A. In the course of this, in the boundary between the scanning areas [1] and [2], the distance between dots recorded in the decimated pattern A in the first scanning and dots recorded in the decimated pattern C in the fourth scanning is increased by 7.5 μm as compared with the standard case. Likewise, the distance between the decimated pattern C recorded in the fourth scanning and the decimated pattern B recorded in the second scanning, and the distance between the decimated pattern C recorded in the fourth scanning and the decimated pattern C recorded in the third scanning are increased by 5.0 μm and 2.5 μm, respectively.

Subsequently, the recording medium is transported by the amount of 128 pulses as in the previous step, and in the fifth scanning, the scanning area [1] is not printed because it has been completed already, the scanning area [2] is completed in the decimated pattern D, the scanning area [3] is printed in the decimated pattern C, the scanning area [4] is printed in the decimated pattern B, and the scanning area [5] is printed in the decimated pattern A. As a result, in the boundary between the scanning areas [1] and [2], the distance between dots recorded in the decimated pattern A in the first scanning and dots recorded in the decimated pattern D in the fifth scanning is increased by 10 μm as compared with the standard case. Likewise, the distance between the decimated pattern D recorded in the fifth scanning and the decimated pattern B recorded in the second scanning, and the distance between the decimated pattern D recorded in the fifth scanning and the decimated pattern C recorded in the third scanning are increased by 7.5 μm and 5.0 μm, respectively.

Thus, in the respective boundaries after the scannings, the separations between the printed regions are increased: The maximum of 10 μm increase takes place in the superimposition of the dots recorded in the fifth scanning on the dots recorded in the first scanning; and the increases between the current scanning and previous scannings are 7.5 μm, 5.0 μm and 2.5 μm, respectively. As a result, the black bandings due to printing with a time delay at the boundaries of problem in the decimated multipass print mode can be reduced by decreasing the superimposition of the dots.

In the one pass print mode, on the other hand, white bandings will take place at the boundaries if the transfer amount is the same as that of the decimated multipass mode, in which the diameter of the sheet transfer roller for transporting the recording medium in the sub scanning direction is increased to increase the transfer amount by about 10 μm from the standard recording height of 10.84 mm per main scanning to prevent image degradation due to the black bandings. Taking account of this, and the fact that the resolution of the motor for driving the sheet transfer roller is double the nozzle density or 1200 dots per inch (1200 dpi), that is, about 20 μm in terms of the transfer amount, the number of pulses is reduced by one pulse to 511 pulses from 512 pulses equal to 256 pulses (nozzles)×2 which is required for transporting the recording medium by the amount of ($^{256}/_{600}$) inch 10.84 mm, that is, the recording height per main scanning. This will reduce the transfer amount by 10 μm from the standard transfer amount of 10.84 mm, because it is decreased by 20 μm from the extra transfer amount of 10 μm.

As described above, the present embodiment can substantially prevent the black bandings due to density unevenness in the decimated multipass print mode by increasing the diameter of the sheet transfer roller for transporting the recording medium in the sub scanning direction so as to reduce the superimposition of dots at the boundaries between the recording scannings, and the white steaks due to error involved in paper incrementing in the one pass print mode by reducing the number of pulses from the standard value so as to produce continuous boundaries between the scanning areas, thereby implementing the compatibility of the two modes.

In the present embodiment, the transfer amount in the sub scanning direction in the one pass print mode which completes an image by one recording scanning is set at $(n/N)+a=10.84$ mm$-10$ μm, where $N=600$ is the density of the nozzles of the recording head per inch (600 dpi), $n=256$ is the number of discharge orifices (the number of nozzles), and $a=-10$ μm$<0$, whereas it is set in the decimated multipass print mode which completes the image by $m=4$ recording scannings at $((n/N)/m)+b=2.71+2.5$ μm for each scanning, where $b=+2.5$ μm$>0$, thereby totaling to 10.84 mm$+10$ μm in the four scannings. However, the value a can be set at any value in a range of $-1/N=-40$ μm$<a\leqq 0$, that is, in the range of superimposition of less than 1/N, and the value b can be set at any value in a range of $0\leqq b<1/(N\times m)=10$ μm, that is, within a separation less than 1/N per m transfer amounts, where 1/N corresponds to one pixel. Furthermore, although the present embodiment uses a fixed pattern as the decimated pattern, a random decimated pattern can be used to prevent tuning with image data.

Carrying out the foregoing control, the present embodiment can prevent, at the boundaries between the scanning areas, both the white bandings due to paper incrementing error in the one pass print mode, and the black bandings due to the density unevenness in the decimated multipass print mode, thereby providing an ink jet recording apparatus capable of implementing high quality image recording.

Second Embodiment

Although the number of discharge orifices actually used in the recording head is the same in both the one pass print mode and decimated multipass print mode in the foregoing first embodiment, it can be varied as in the present embodiment which applies the present invention to such a case.

Figure 1:
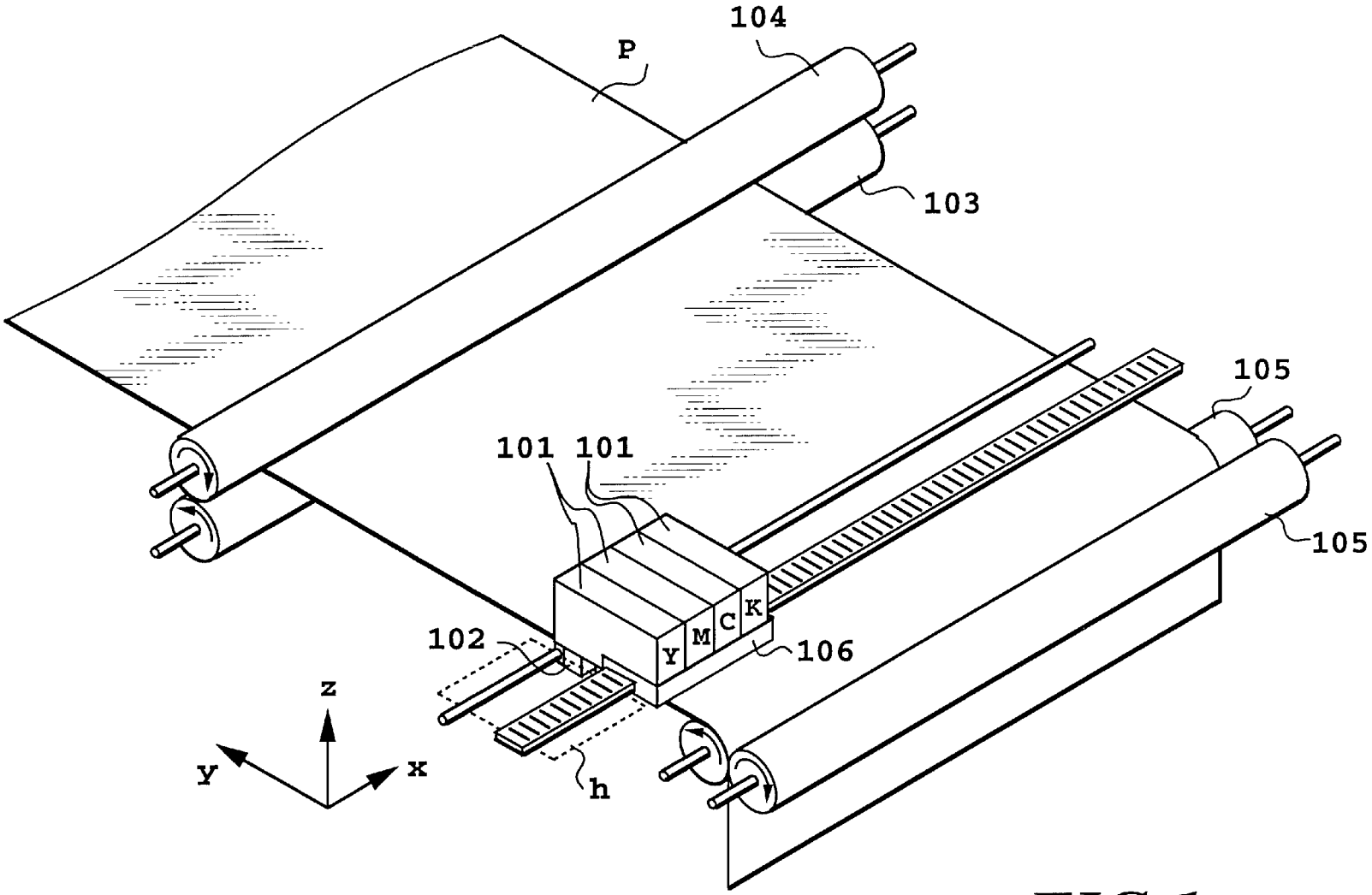
FIG. 1 is a schematic perspective view showing an example of an ink jet recording apparatus associated with an embodiment in accordance with the present invention.
Figure 2:
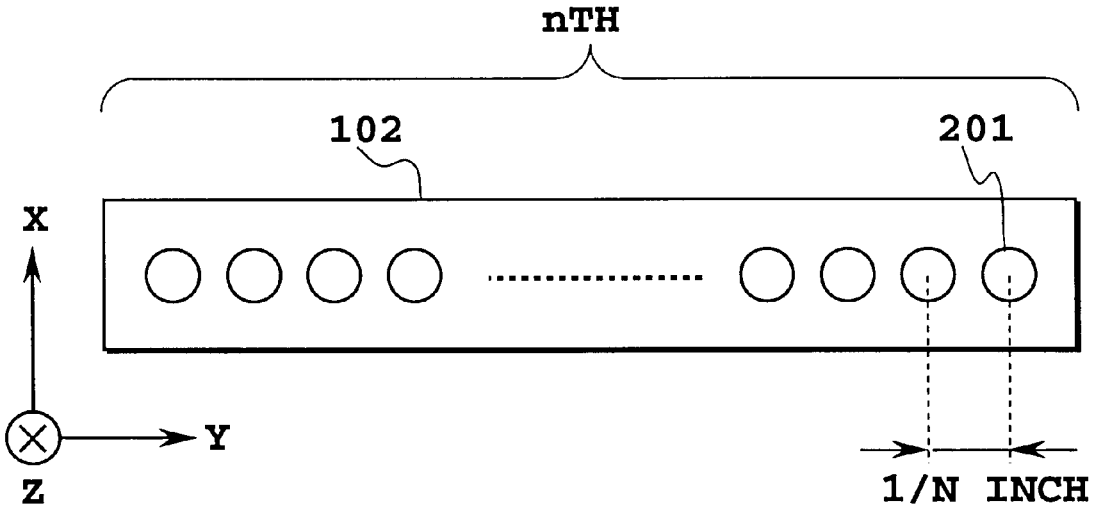
FIG. 2 is a schematic diagram showing a nozzle arrangement of a recording head associated with an embodiment in accordance with the present invention.
Figures 3A, 3B, 3C:
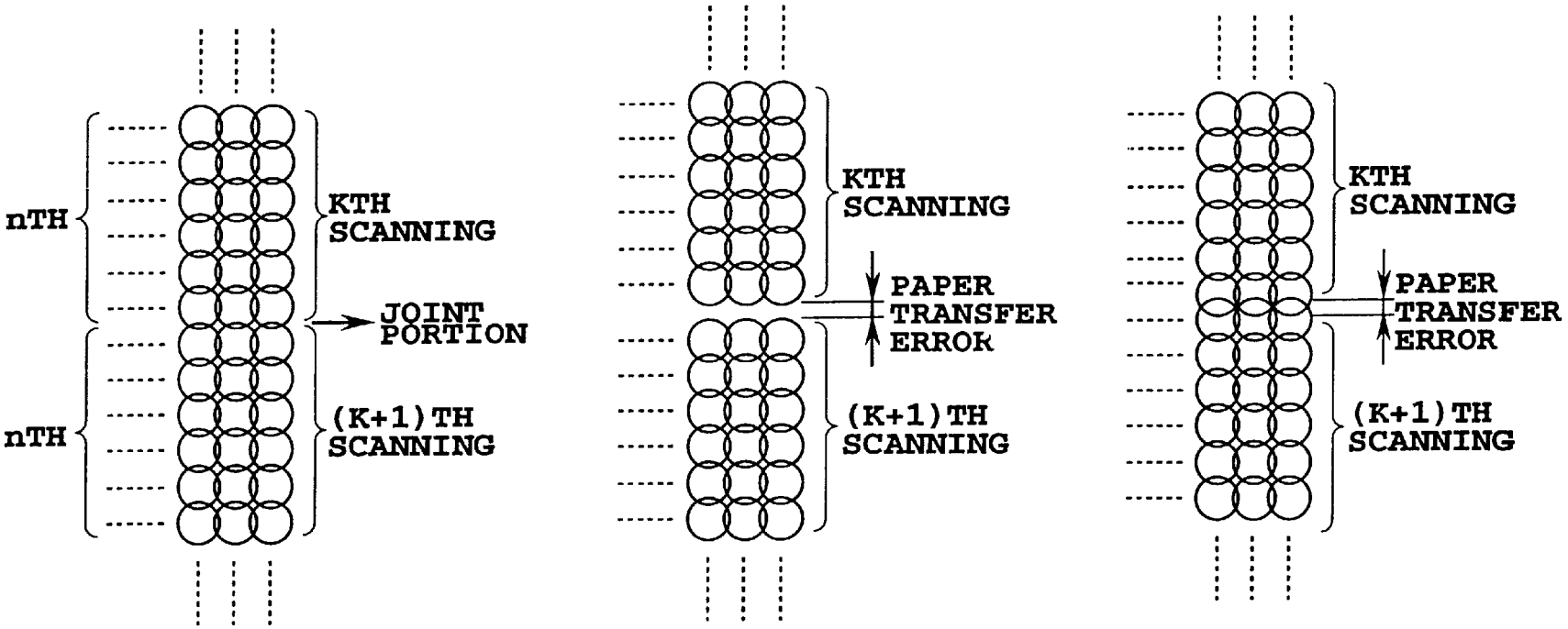
FIG.3A PRIOR ART
FIG.3B PRIOR ART
FIG.3C PRIOR ART
FIGS. 3A to 3C are diagrams illustrating example of joint portions of conventional scanning areas.
Figure 4C:
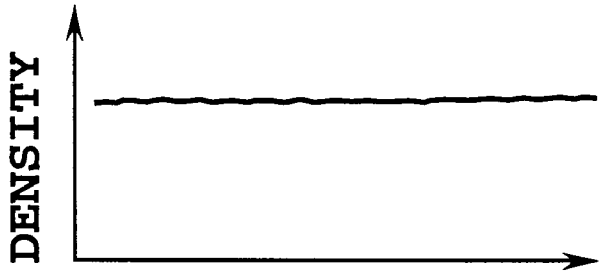
FIGS. 4A to 4C are diagrams illustrating ideal printed state without density unevenness.
Figure 4B:
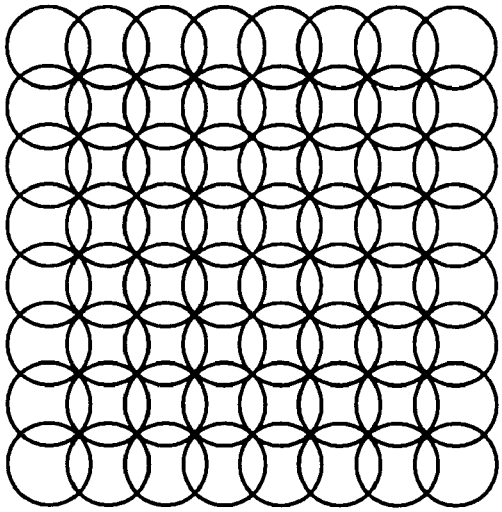
Figure 4A:
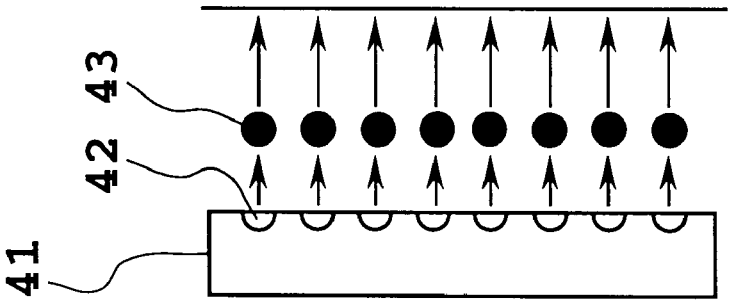
Figure 5C:
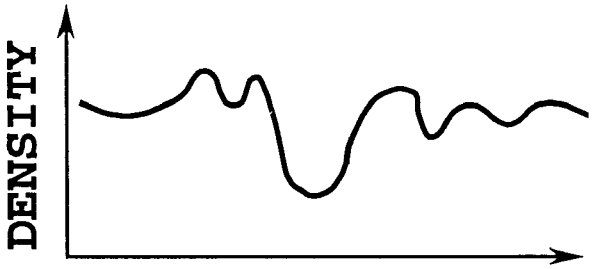
FIGS. 5A to 5C are diagrams illustrating printed state with density unevenness.
Figure 5B:
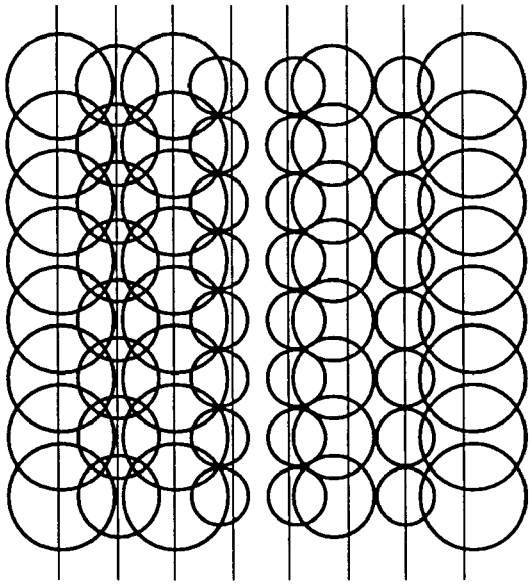
Figure 5A:
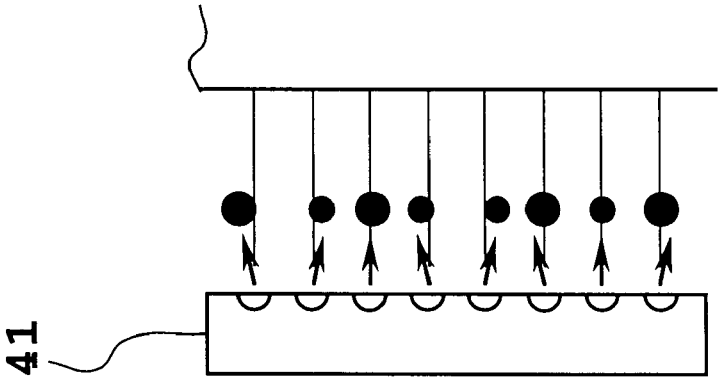
Figure 6C:
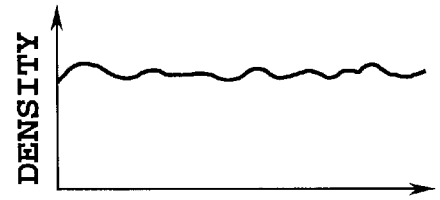
FIG.6C PRIOR ART
FIGS. 6A to 6C are diagrams illustrating a decimated multipass print mode for reducing the conventional density unevenness.
Figure 6B:
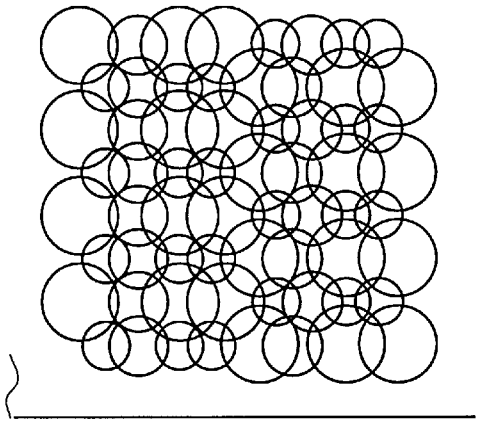
FIG.6B PRIOR ART
Figure 6A:
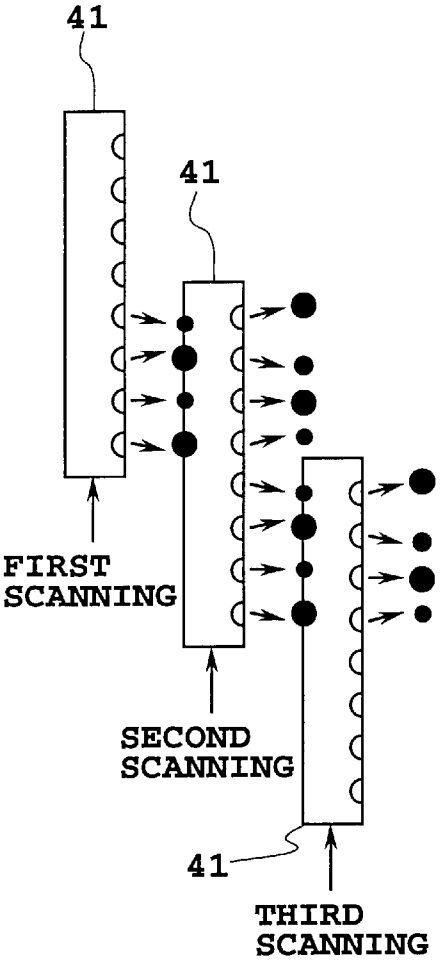
FIG.6A PRIOR ART
Figure 7A:
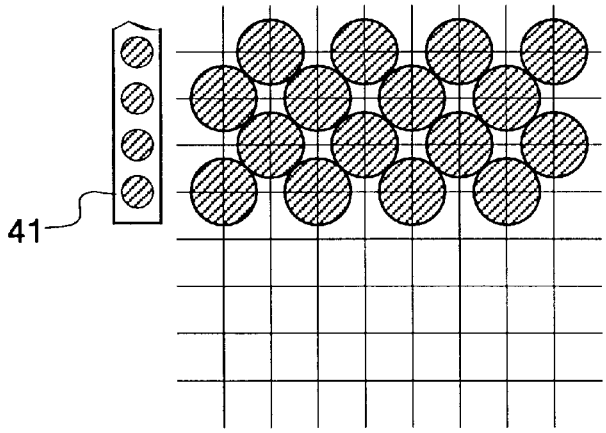
FIG.7A PRIOR ART
FIGS. 7A to 7C are diagrams illustrating a decimated multipass print mode for reducing the conventional density unevenness.
Figure 7B:
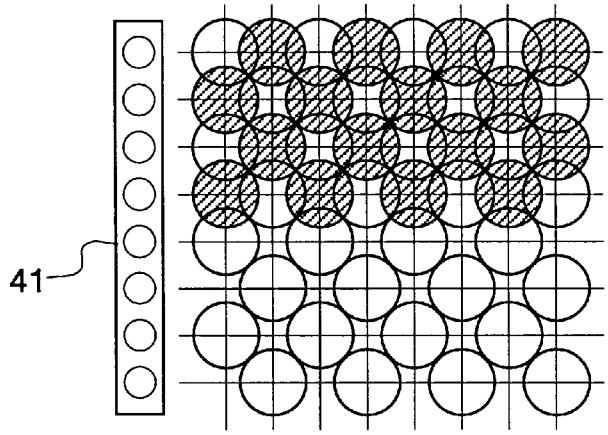
FIG.7B PRIOR ART
Figure 7C:
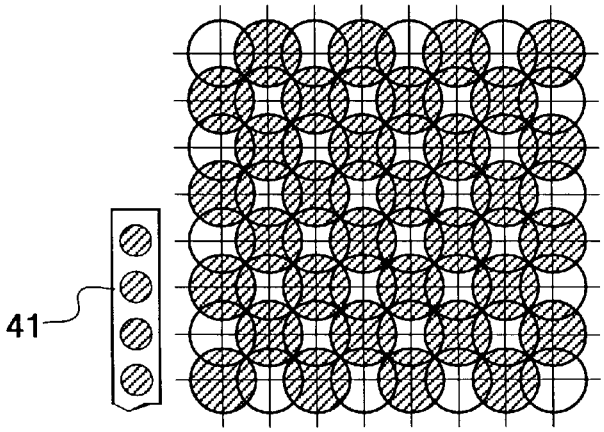
FIG.7C PRIOR ART
Figures 8A, 8B, 8C, 8D:
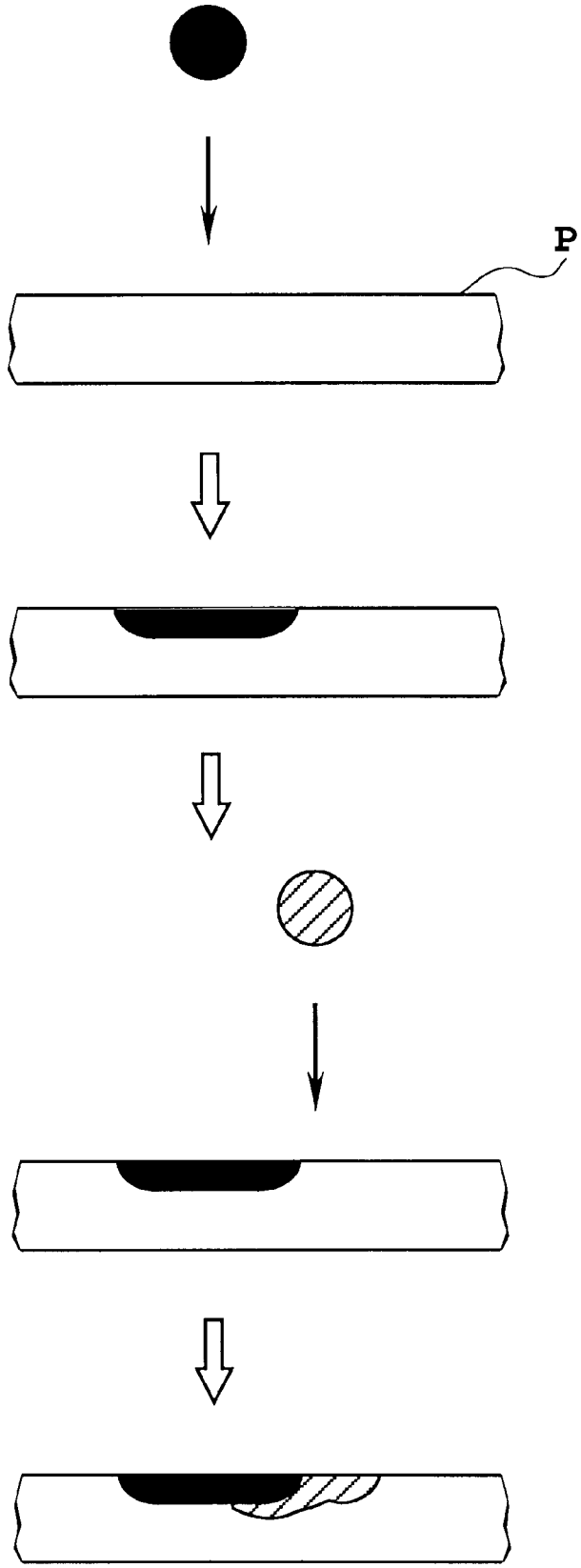
FIGS. 8A to 8D are diagrams illustrating superimposition of dots.

When a color picture is printed in the structure in which black, cyan, magenta and yellow are arranged in the main scanning direction as shown in FIG. 1, it is sometimes necessary for the recording heads to undergo displacement correction in the sub scanning direction between each other. Each of the recording heads of respective colors has $n=256$ discharge orifices (256 nozzles) at a density of $N=600$ nozzles per inch (600 dpi). In the one pass print mode which prints monochromatic picture at a high speed, the displacement correction in the sub scanning direction is not needed because only the black recording head is used in this mode, and the number of the discharge orifices used is the maximum of n=256. On the other hand, in the decimated multipass print mode, the displacement correction in the sub scanning direction is carried out using each two nozzles at the top and bottom in the nozzle arrangement of each recording head, so that the number of the discharge orifices used is n (=252). In addition, the resolution of one pulse of the motor for driving the sheet transfer roller for transporting the recording medium is 1200 dots per inch (1200 dpi) corresponding to double the nozzle density, that is, about 20 μm in terms of the transfer amount.

In the ideal case in which there arises no error in the scanning distance in the sub scanning direction, the height per main scanning in one pass print mode is (n/N)=(256/600) inch≈10.84 mm, and the recording medium should be shifted in the sub scanning direction by that amount. In contrast, in the decimated multipass print mode, in which the nozzle column is divided by m (=4) and an image is completed in m (=4) scannings, the recording medium should be shifted by 2.67 mm per scanning in the sub scanning direction, which is nearly equal to (n/m)/N=(63/600) inch, corresponding to 63 nozzle height or (n/m)=(252/4)=63 obtained by dividing by four the recording height per scanning of (n/N)=(252/600) inch≈10.67 mm.

In reality, however, there arises some error in the transfer distance as described before. Accordingly, it is necessary for the one pass print mode to prevent a space from taking place at the boundaries between the sub scannings by superimposing in part the printed regions at the boundaries. On the other hand, it is necessary for the decimated multipass print mode to prevent the black bandings from taking place at the boundaries of the sub scannings by reducing the superimposition of the printed regions.

To prevent the image degradation due to the black bandings in the decimated multipass print mode, the second embodiment increases as in the foregoing first embodiment the diameter of the sheet transfer roller for transporting the recording medium in the sub scanning direction as compared with the standard value. Specifically, the transfer distance is increased by 10 μm from the transfer distance of 10.67 mm corresponding to the recording height of one main scanning using 252 discharge orifices. This can prevent the superimposition of dots at the boundaries from exceeding an amount of a standard superimposition, even if the transfer error takes place. In the decimated multipass print mode of the present embodiment, which completes the image in four scannings, the transfer distance is increased by 10 μm/4=2.5 μm per scanning from that of the standard distance.

Figure 12:
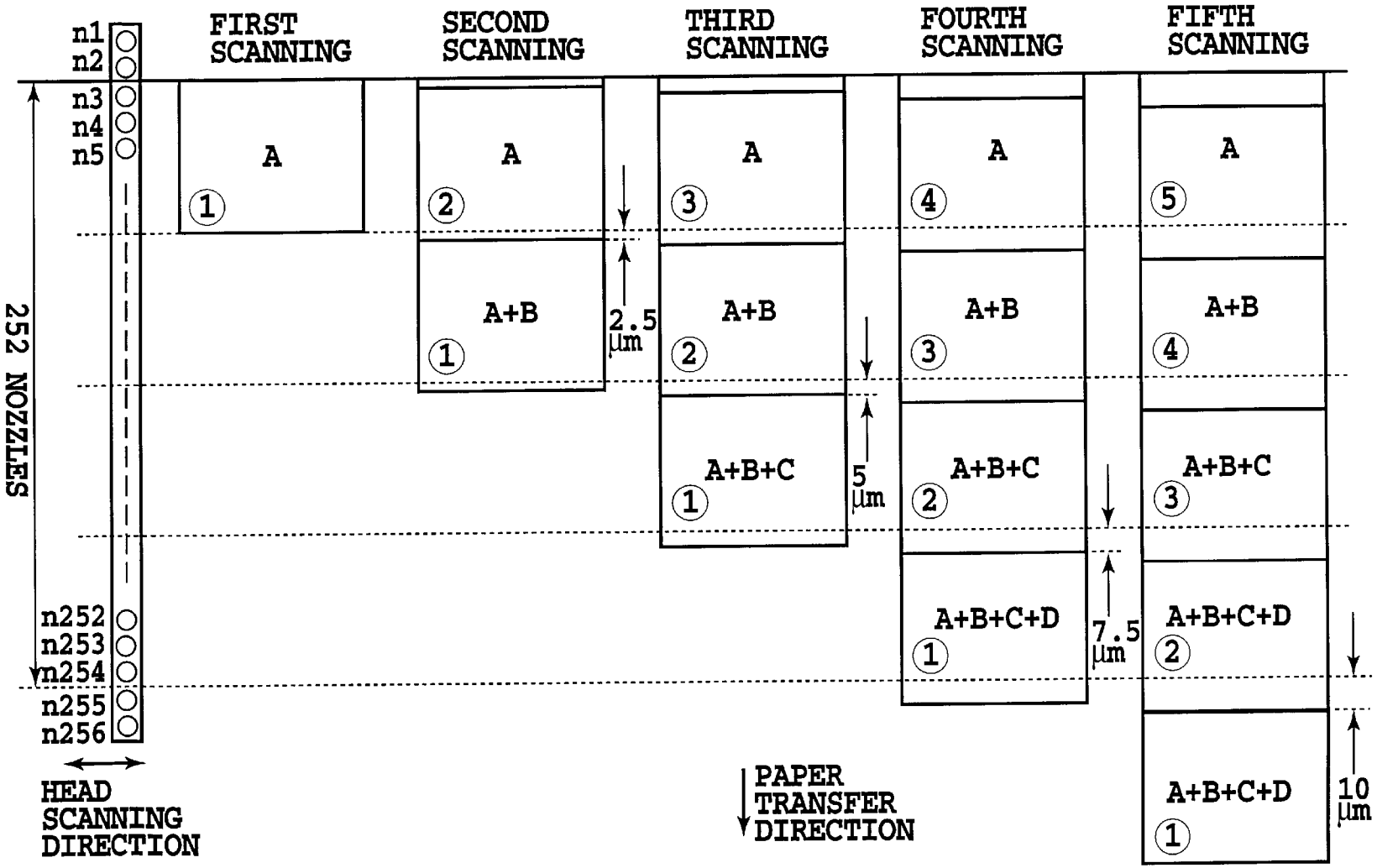
FIG. 12 a diagram illustrating a recording method in the decimated multipass print mode in the second embodiment in accordance with the present invention.

Referring to FIGS. 10 and 12, a recording method in the decimated multipass print mode will be described, in which each two nozzles at the top and bottom in the 256 nozzles of each recording head is not used as a result of carrying out between the recording heads the displacement correction in the sub direction.

First, as shown in FIG. 12, printing is carried out in the first scanning in the decimated pattern A as shown in FIGS. 10A to 10D using 63 nozzles from the third to 65th nozzles of the 256 nozzles.

Subsequently, the paper transfer motor is driven to transport the recording medium in the sub scanning direction by an amount of 63 nozzles×2=128 pulses. The transfer distance in this case is (63/600) inch≈2.67 mm plus 2.5 μm. In the second scanning, using 63×2=126 nozzles from the third to 128th nozzles of the recording heads, the scanning area [1] is printed in the decimated pattern B as shown in FIGS. 10A to 10D, and the scanning area [2] is printed using the decimated pattern A as shown in FIGS. 10A to 10D. In the course of this, in the boundary between the scanning areas [1] and [2], the distance between dots recorded in the decimated pattern A in the first scanning and in the second scanning is increased by 2.5 μm as compared with the standard case.

Afterward, the recording medium is transported by the amount of 126 pulses as in the previous step, and in the third scanning, using 63×3=189 nozzles from the third to 191th nozzles of the recording head, the scanning area [1] is printed in the decimated pattern C as shown in FIGS. 10A to 10D, the scanning area [2] is printed in the decimated pattern B, and the scanning area [3] is printed in the decimated pattern A. In the course of this, in the boundary between the scanning areas [1] and [2], the distance between dots recorded in the decimated pattern A in the first scanning and dots recorded in the decimated pattern B in the third scanning is increased by 5.0 μm as compared with the standard case. Likewise, the distance between dots recorded in the decimated pattern B in the second scanning and in the third scanning is increased by 2.5 μm as compared with the standard case. Subsequently, the recording medium is transported by the amount of 126 pulses as in the previous step, and in the fourth scanning, using 63×4=252 nozzles from the third to 254 nozzles of the recording head, the scanning area [1] is completed in the decimated pattern D as shown in FIGS. 10A to 10D, the scanning area [2] is printed in the decimated pattern C, the scanning area [3] is printed in the decimated pattern B, and the scanning area [4] is printed in the decimated pattern A. In the course of this, in the boundary between the scanning areas [1] and [2], the distance between dots recorded in the decimated pattern A in the first scanning and dots recorded in the decimated pattern C in the fourth scanning is increased by 7.5 μm as compared with the standard case. Likewise, the distance between dots recorded in the pattern C in the fourth scanning and dots recorded in the pattern B in the second scanning, and the distance between dots recorded in the pattern C in the fourth scanning and dots recorded in the pattern C in the third scanning are increased by 5.0 μm and 2.5 μm, respectively.

Subsequently, the recording medium is transported by the amount of 126 pulses as in the previous step, and in the fifth scanning, using the 252 nozzles used in the fourth scanning, the scanning area [1] is not printed because it has already been completed, the scanning area [2] is completed in the decimated pattern D, the scanning area [3] is printed in the decimated pattern C, the scanning area [4] is printed in the decimated pattern B, and the scanning area [5] is printed in the decimated pattern A. As a result, in the boundary between the scanning areas [1] and [2], the distance between dots recorded in the decimated pattern A in the first scanning and dots recorded in the decimated pattern D in the fifth scanning is increased by 10 μm as compared with the standard case. Likewise, the distances between dots recorded in the pattern D and the patterns B, C and D between the scanning areas [2] and [1] are increased by 7.5 μm, 5.0 μm and 2.5 μm, respectively.

Thus, at the respective boundaries of the scanning areas, with the maximum of 10 μm separation of the dots recorded in the first and fifth scannings, the dot distances of 7.5 μm, 5.0 μm and 2.5 μm take place between the patterns of the areas.

In the one pass print mode, on the other hand, if the paper transport is carried out using the sheet transfer roller with a diameter greater than the standard one, the transfer amount is increased by about 10 μm from the standard recording height of 10.84 mm per main scanning. Taking account of this, in the present embodiment, as in the first embodiment, the number of pulses is reduced by one pulse to 511 pulses from 512 pulses equal to 256 pulses (nozzles)×2 which is required for transporting the recording medium by the amount of ($^{256}/_{600}$) inch≈10.84 mm, that is, the recording height per main scanning, so that the transfer amount is reduced by 10 μm from the standard transfer amount of 10.84 mm, because 10 μm−20 μm=−10 μm.

As described above, the present embodiment, which uses different number of discharge orifices of the recording head in the one pass print mode and in the decimated multipass print mode, can prevent not only the black bandings due to density unevenness in the decimated multipass print mode by increasing the diameter of the sheet transfer roller for transporting the recording medium in the sub scanning direction so as to reduce the superimposition of dots at the boundaries between the recording scannings, but also the white steaks due to error during the paper incrementing in the one pass print mode by reducing the number of pulses to the motor for driving the sheet transfer roller from the standard one so as to form continuous boundaries between the scanning areas even if the roller diameter is greater than the standard one, thereby providing an ink jet recording apparatus that can implement high quality image recording.

Third Embodiment

The third embodiment applies the present invention to a case that records in the one pass print mode at a resolution corresponding to the nozzle pitch of the recording head, while in the decimated multipass print mode at a resolution twice that resolution.

As in the second embodiment, each of the recording heads of respective colors has n=256 discharge orifices (256 nozzles) at a density of N=600 nozzles per inch (600 dpi). In the one pass print mode which prints monochromatic picture at a high speed, the displacement correction in the sub scanning direction is not needed because only the black recording head is used in this mode, and the number of the discharge orifices used is the maximum of n=256. On the other hand, in the decimated multipass print mode, the displacement correction in the sub scanning direction is carried out using each two nozzles at the top and bottom in the nozzle arrangement of each recording head, so that the number of the discharge orifices used is n=252. In addition, the resolution of one pulse of the motor for driving the sheet transfer roller to transport the recording medium is 1200 dots per inch (1200 dpi) corresponding to double the nozzle density.

In the ideal case in which there arises no error in the scanning distance in the sub scanning direction, the recorded height per main scanning in one pass print mode is (n/N)=($^{256}/_{600}$) inch≈10.84 mm. In contrast, in the decimated multipass print mode, in which the nozzle column is divided by m (=4) and an image is completed in m (=4) scannings, the recorded height per main scanning is (n/N)=($^{252}/_{600}$) inch≈10.67 mm. Accordingly, two types of transports of the recording medium should be alternately repeated to complete an image of 1200 dpi for the nozzle height of (n/m)=(252/4)=63 nozzles obtained by dividing the value by four: First, the recording medium should be transported by an amount corresponding to (n/m)−0.5=62.5 nozzle height, that is {(n/m)−0.5}/N=($^{62.5}/_{600}$) inch≈2.65 mm; and second, by an amount corresponding to (n/m)+0.5=63.5 nozzle height, that is {(n/m)+0.5}/N=($^{63.5}/_{600}$) inch≈2.69 mm.

In reality, however, there arises some error in the transfer distance as described before. Accordingly, it is necessary in the one pass print mode to superimpose in part the printed regions at the boundaries for individual sub scannings to prevent a space at the boundaries between the sub scannings. On the other hand, it is necessary in the decimated multipass print mode to reduce the superimposition of the printed regions for individual sub scannings to prevent the black bandings at the boundaries of the sub scannings.

To prevent the image degradation due to the black bandings in the decimated multipass print mode, the third embodiment increases as in the foregoing two embodiments the diameter of the sheet transfer roller for transporting the recording medium in the sub scanning direction as compared with the standard diameter. Specifically, the transfer distance is increased by 10 μm from the transfer distance of 10.67 mm corresponding to the recording height of one main scanning using 252 discharge orifices. This can prevent the superimposition of dots at the boundaries from exceeding an amount of a standard superimposition, even if the transfer error takes place. In the decimated multipass print mode of the present embodiment, which completes the image in four scannings, the transfer distance is increased by 10 μm/4=2.5 μm per main scanning from that of the standard distance.

Figures 13A, 13B, 13C, 13D:
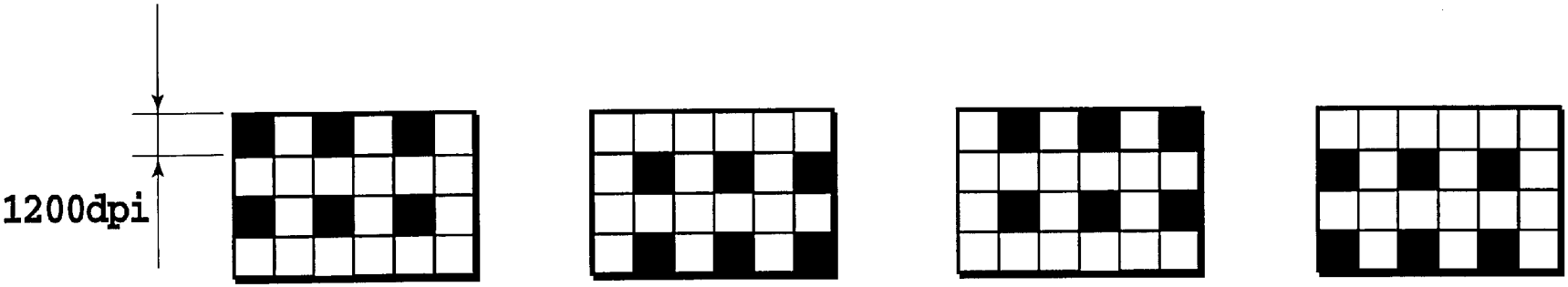
FIGS. 13A to 13D are diagrams schematically illustrating decimated patterns used in the third embodiment in accordance with the present invention.
Figure 14:
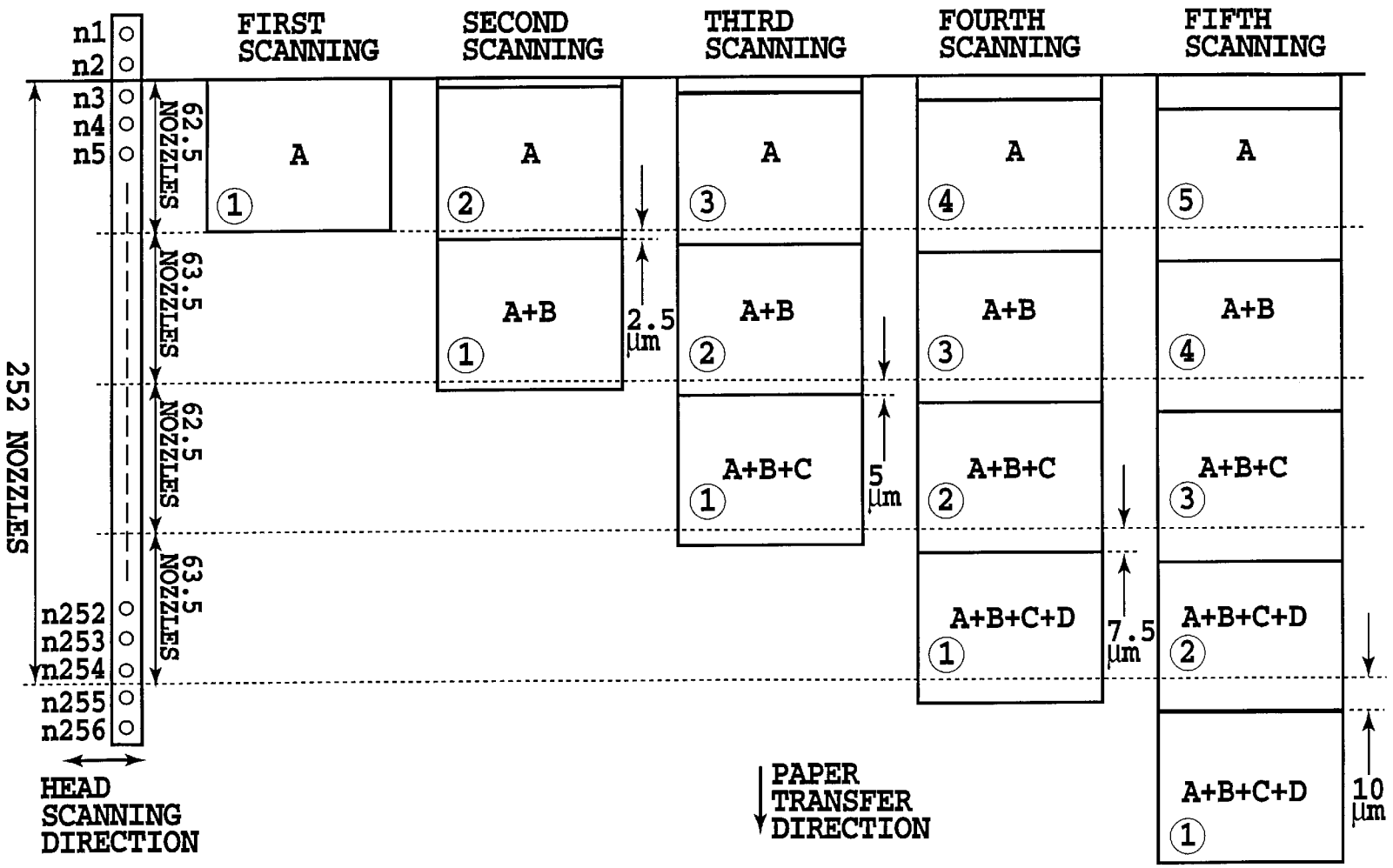
FIG. 14 is a diagram illustrating a recording method in the decimated multipass print mode in the third embodiment in accordance with the present invention.

Referring to FIGS. 13 and 14, a recording method in the decimated multipass print mode in the present embodiment will be described which carries out recording at a resolution of twice the nozzle pitch.

FIGS. 13A to 13D are schematic view showing decimated patterns used in the present embodiment. As shown in FIGS. 13A to 13D, the four decimated patterns A to D are complementary to each other, and each have a resolution of 1200 dpi in the sub scanning direction. The patterns A and C are complementary to each other in odd line pixels in the sub scanning direction, while the patterns B and D are complementary to each other in even line pixels in that scanning direction.

First, as shown in FIG. 14, printing of odd line pixels in the sub scanning direction is carried out in the first scanning in the decimated pattern A as shown in FIGS. 13A to 13D using 63 nozzles from the third to 65th nozzles of the 256 nozzles.

Subsequently, the paper transfer motor is driven to transport the recording medium in the sub scanning direction by an amount of 62.5 nozzles×2=125 pulses. The transfer distance in this case is ($^{62.5}/_{600}$) inch≈2.65 mm plus 2.5 μm. Afterward, in the second scanning, using 63×2=126 nozzles from the third to 128th nozzles of the recording heads, printing of even line pixels in the sub scanning direction is carried out in the scanning areas [1] and [2] using the decimated pattern B as shown in FIGS. 13A to 13D. In the course of this, in the boundary between the scanning areas [1] and [2], the distance between dots recorded in the decimated pattern A in the first scanning and dots recorded in the decimated pattern B in the second scanning is increased by 2.5 μm as compared with the standard case, and the dots in the scanning area [3] ([1] are formed at 1200 dpi.

Afterward, the paper transport motor is driven by the amount of 63.5 nozzles×2, that is, 127pulses to shift the recording medium in the sub scanning direction, and in the third scanning, using 63×3=189 nozzles from the third to 191th nozzles of the recording head, printing of the odd line pixels in the sub scanning direction is carried out in the scanning area [1] in the decimated pattern C as shown in FIGS. 13A to 13D, and in the scanning areas [2] and [3] in the decimated pattern A. In the course of this, in the boundary between the scanning areas [1] and [2], the distance between dots recorded in the decimated pattern A in the first scanning and in the third scanning is increased by 5.0 μm as compared with the standard case. Likewise, the distance between dots recorded in the decimated pattern B in the second scanning and dots recorded in the decimated pattern A in the third scanning is increased by 2.5 μm as compared with the standard case.

Subsequently, the paper transport motor is driven by the amount of 62.5 nozzles×2 or 125 pulses to shift the recording medium in the sub scanning direction, and in the fourth scanning, using 63×4=252 nozzles from the third to 254 nozzles of the recording head, the scanning area [1] is completed in the decimated pattern D as shown in FIGS. 13A to 13D, the scanning area [2] is also printed in the decimated pattern D, and the scanning areas [3] and [4] are printed in the decimated pattern B. In the course of this, in the boundary between the scanning areas [1] and [2], the distance between dots recorded in the decimated pattern A in the first scanning and dots recorded in the decimated pattern D in the fourth scanning is increased by about 7.5 μm as compared with the standard case. Likewise, the distances between dots recorded in the respective patterns are increased by 5.0 μm and 2.5 μm, respectively.

Subsequently, the paper transport motor is driven by the amount of 63.5 nozzles×2 or 127 pulses to shift the recording medium in the sub scanning direction, and in the fifth scanning, using the 252 nozzles used in the fourth scanning, the odd line pixels in the sub scanning direction are completed in the scanning area [2] in the decimated pattern C as shown in FIGS. 13A to 13D, are printed in the scanning area [3] in the decimated pattern C, and in the scanning areas [4] and [5] in the decimated pattern A. As a result, in the boundary between the scanning areas [1] and [2], the distance between dots recorded in the decimated pattern A in the first scanning and dots recorded in the decimated pattern C in the fifth scanning is increased by 10 μm as compared with the standard case. Likewise, the distances between dots recorded in the foregoing patterns between the scanning areas are increased by 2.5 μm, 5.0 μm and 7.5 μm, respectively.

Thus, at the respective boundaries of the scanning areas, with the maximum of 10 μm separation of the dots recorded in the first and fifth scannings, the dot distances of 7.5 μm, 5.0 μm and 2.5 μm take place between the patterns of the regions. This makes it possible in the decimated multipass print mode to reduce the black bandings which would take place owing to dots with a time delay of one scanning time period, which are produced in respective scanning areas.

In the one pass print mode, on the other hand, if the sheet transfer roller is used which is used in the decimated multipass print mode, the transfer amount is increased by about 10 μm from the standard recording height of 10.84 mm per main scanning. Taking account of this, in the present embodiment, as in the first and second embodiments, the number of pulses is reduced by one pulse to 511 pulses from 512 pulses equal to 256 pulses (nozzles)×2 which is required for transporting the recording medium in the sub scanning direction by the amount of ($^{256}/_{600}$) inch≈10.84 mm, that is, the recording height per main scanning, so that the transfer amount is reduced by 10 μm from the standard transfer amount of 10.84 mm, because 10 μm−20 μm=−10 μm. This makes it possible to prevent the white bandings even if the paper transfer errors take place.

In the present embodiment, the transfer amount of the recording medium in the sub scanning direction in the one pass print mode is reduced by 10 μm from the standard value (a=−10 μm), and it is increased in the decimated multipass print mode by 2.5 μm (b=+2.5 μm) from the standard value. However, the value a can be set at any value in a range of −1/N=−40 μm<a≦0, that is, in the range of superimposition of less than 1/N corresponding to one pixel, and the value b can be set at any value in a range of 0≦b<1/(N×2×m)=5 μm, that is, within a separation less than 1/(N×2) corresponding to one pixel per m transfer amounts.

As described above, the present embodiment can prevent, in the decimated multipass print mode that carries out recording at the picture resolution of twice the nozzle density of the recording head, the black bandings due to density unevenness by increasing the diameter of the sheet transfer roller for transporting the recording medium in the sub scanning direction so as to reduce the superimposition of dots at the boundaries between the recording scannings. At the same time, in the one pass print mode that carries out printing at the nozzle density to achieve high speed printing, the white bandings due to the paper incrementing errors by reducing the paper transfer amount as compared with the standard number of pulses so as to form continuous boundaries between the scanning areas, thereby providing an ink jet recording apparatus that can implement high quality image recording.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording apparatus which carries out recording using a recording head with a plurality of ink discharge orifices provided at predetermined intervals for recording on a recording medium, said ink jet recording apparatus comprising:

scanning means for scanning said recording head in a main scanning direction, in which recording is carried out on a unit area on the recording medium, said unit area corresponding to said plurality of ink discharge orifices;

transfer means for transporting said recording medium in a subscanning direction in contrast to said main scanning direction; and recording control means for recording on said one unit area based on recording data by driving said recording head, during the time in which said recording head is being driven in the main scanning direction, wherein said recording control means increases a transfer amount of transporting said recording medium in the subscanning direction by an amount less than that of the predetermined interval as compared with a height of each subdivided area into which said unit area is divided on said recording medium in a multipass print mode on which recording is performed based on the recording data for said subdivided area of said recording medium in a plurality of scannings of said recording head in the main scanning direction.

2. The ink jet recording apparatus as claimed in claim 1, wherein said recording control means reduces, in a one-pass print mode that recording is performed based on the recording data on said unit area on said recording medium in a single scanning of said recording head in the main scanning direction, a transfer amount of transporting said recording medium in said sub scanning direction by an amount less than that of the predetermined interval as compared with a height of said unit area in the transporting direction.

3. The ink jet recording apparatus as claimed in claim 2, wherein said recording control means transports, in said one-pass print mode, said recording medium in the sub scanning direction by an amount of $[(n/N)+a]$ inch to record based on the recording data on said unit area, where a is a value in a range of $-1/N<a\leqq 0$, and wherein said recording control means comprises, as the multipass print mode, a decimated multipass print mode for recording on said plurality of subdivided areas using decimated patterns that are complementary to each other, and in said multipass print mode, transports said recording medium in the sub scanning direction by an amount of $[\{(n/m)/N\}+b]$ inch, where N is a density of the plurality of discharge orifices of said recording head per inch, n is a number of the discharge orifices, recording height on said recording medium in a single scanning is about n/N inch, m is a number of subdivided areas in the unit area, and b is a value in a range of $0 \leqq b < 1/(N \times m)$.

4. The ink jet recording apparatus as claimed in claim 3, wherein said transfer means is constructed such that a recording medium transfer roller has a diameter greater than a standard size, and in said decimated multipass print mode, said recording control means drives said transfer roller just as in the standard driving method.

5. The ink jet recording apparatus as claimed in claim 3, wherein said recording control means performs said decimated multipass print mode by transporting said recording medium in the sub scanning direction alternately by an amount of $[[\{(n/m)+0.5\}/N]+b]$ inch and $[[\{(n/m)-0.5\}/N]+b]$ inch in a print mode that carries out printing at a density of $(N \times 2)$ dots per inch, where b is a value in a range of $0 \leqq b < 1/(N \times 2 \times m)$.

6. The ink jet recording apparatus as claimed in claim 3, wherein said recording control means, in said one-pass print mode, reduces a number of drive pulses of a motor for driving the recording medium transfer roller as compared with a standard number of pulses.

7. The ink jet recording apparatus as claimed in claim 3, wherein the number n of said discharge orifices used in said decimated multipass print mode is less than the number of discharge orifices used in said one-pass print mode.

8. The ink jet recording apparatus as claimed in claim 1, wherein said recording control means comprises, as the multipass print mode, decimated multipass print mode for recording on said plurality of subdivided areas using decimated patterns that are complementary to each other, and in said decimated multipass print mode, said recording medium is transported in the sub scanning direction by an amount of $[\{(n/m)/N\}+b]$ inch, where N is a density of the plurality of discharge orifices of said recording head per inch, and n is a number of the discharge orifices, recording height on said recording medium in a single scanning is about n/N inch, m is a number of the subdivided areas in the unit area, and b is a value in a range of $0 \leqq b < 1/(N \times m)$.

9. The ink jet recording apparatus as claimed in claim 8, wherein said transfer means is constructed such that a recording medium transfer roller has a diameter greater than a standard size, and in said decimated multipass print mode, said recording control means drives said transfer roller just as in the standard driving method.

10. The ink jet recording apparatus as claimed in claim 8, wherein said recording control means performs said decimated multipass print mode by transporting said recording medium in the sub scanning direction alternately by an amount of $[[\{(n/m)+0.5\}/N]+b]$ inch and $[[\{(n/m)-0.5\}/N]+b]$ inch in a print mode that carries out printing at a density of $(N \times 2)$ dots per inch, where b is a value in a range of $0 \leqq b < 1/(N \times 2 \times m)$.

11. The ink jet recording apparatus as claimed in claim 1, wherein said recording head comprises electrothermal converting elements for generating energy for producing film boiling of ink as energy that is applied to discharging said ink.

12. An ink jet recording method that records data on a unit area on a recording medium based on recording data by driving a recording head, during the time in which said recording head is being driven in the main scanning direction, said unit area on said recording medium corresponding to a plurality of ink discharge orifices provided at predetermined intervals in said recording head, said recording method comprising the steps of:

reducing, in a one-pass print mode that records data on the basis of a recorded data on said unit area on said recording medium in a single scanning in the main scanning direction of said recording head, a transfer amount of transporting said recording medium by an amount less than that of the predetermined interval in said subscanning direction as compared with a height of said unit area in the subscanning direction; and increasing, in a decimated multipass print mode as the multipass print mode that records data on the basis of recorded data on subdivided areas of said recording medium in a plurality of scannings of said recording head in the main scanning direction, a transfer amount of transporting said recording medium by an amount less than that of the predetermined interval in the sub scanning direction as compared with a height of each of subdivided areas into which said unit area is divided on said recording medium.

13. The ink jet recording method as claimed in claim 12, comprising the steps of:

shifting, in said one-pass print mode, said recording medium in the sub scanning direction by an amount of $[(n/N)+a]$ inch to record based on the recording data on said unit area, where a is a value in a range of $-1/N < a \leqq 0$, and shifting said recording medium, in said decimated multipass print mode, in the sub scanning direction by an amount of $[\{(n/m)/N\}+b]$ inch, where N is a density of the plurality of discharge orifices of said recording head per inch, and n is a number of the discharge orifices, recording height on said recording medium in a single scanning is about n/N inch, m is a number of subdivided areas in the unit area, and b is a value in a range of $0 \leqq b < 1/(N \times m)$.

14. The ink jet recording method as claimed in claim 13, wherein in said decimated multipass print mode, a recording medium transfer roller has a diameter greater than a standard size and is driven just as in the standard driving method, and shifts said recording medium in the sub scanning direction alternately by an amount of $[[\{(n/m)+0.5\}/N]+b]$ inch and $[[\{(n/m)-0.5\}/N]+b]$ inch, where b is a value in a range of $0 \leqq b < 1/(N \times 2 \times m)$ to perform printing at a density of $(N \times 2)$ dots per inch.

15. The ink jet recording method as claimed in claim 13, further comprising the steps of reducing, as means for shifting said recording medium in the sub scanning direction by an amount of $[(n/N)+a]$ inch per scanning, a number of drive pulses of a motor for driving a recording medium transfer roller as compared with a standard number of pulses in said one-pass print mode.

16. An ink jet recording method which carries out recording using a recording head with a plurality of ink discharge orifices provided at predetermined intervals for recording on a recording medium, said method comprising the steps of:

scanning said recording head in a main scanning direction, in which recording is carried out on a unit area on the recording medium, said unit area corresponding to said plurality of ink discharge orifices;

transporting said recording medium in a sub scanning direction in contrast to said main scanning direction; and recording on said one unit area based on recording data by driving said recording head, during the time in which said recording head is being driven in the main scanning direction, wherein said recording step increases a transfer amount of transporting said recording medium in the subscanning direction by an amount less than that of the predetermined interval as compared with a height of subdivided areas that constitute said unit area of said recording medium in a multipass print mode on which recording is performed based on the recording data on said subdivided area of said recording medium in a plurality of scannings of said recording head in the main scanning direction.

* * * * *

UNITED STATES PATENT AND TRADEMARK OFFICE

CERTIFICATE OF CORRECTION

PATENT NO. : 6,145,960

DATED : November 14, 2000

INVENTORS : HIDEHIKO KANDA, et al.

It is certified that error appears in the above-identified patent and that said Letters Patent is hereby corrected as shown below:

COLUMN 7

Line 12, "a" (first occurrence) should read --is a--.

COLUMN 8

Line 6, "Embodiments" should read --embodiment--; and
Line 61, "$(^{64}/_{600})$" should read --64/100--.

COLUMN 10

Line 13, "$(^{256}/_{600})$" should read --256/600--;
Line 15, "10μn" should read --10μm--; and
Line 23, "steaks" should read --streaks--.

COLUMN 11

Line 18, "$(^{256}/_{600})$" should read --256/600--;
Line 25, "$(^{63}/_{600})$" should read --63/600--;
Line 28, "$(^{252}/_{600})$" should read --252/600--; and
Line 66, "$(^{63}/_{600})$" should read --63/600--.

COLUMN 13

Line 8, "$(^{256}/_{600})$" should read --256/600--;
Line 20, "steaks" should read --streaks--.

UNITED STATES PATENT AND TRADEMARK OFFICE

CERTIFICATE OF CORRECTION

PATENT NO. : 6,145,960

DATED : November 14, 2000

INVENTORS : HIDEHIKO KANDA, et al.

It is certified that error appears in the above-identified patent and that said Letters Patent is hereby corrected as shown below:

COLUMN 13 (Cont.)

Line 53, "$(^{256}/_{600})$" should read --256/600--;
Line 56, "$(^{256}/_{600})$" should read --256/600--;
Line 63, "$(^{62.5}/_{600})$" should read --62.5/600--; and
Line 65, "$(^{62.5}/_{600})$" should read --62.5/600--.

COLUMN 14

Line 44, "$(^{62.5}/_{600})$" should read --62.5/600--.

COLUMN 15

Line 56, "$(^{256}/_{600})$" should read --256/600--..

COLUMN 17

Line 9, "consists" should read --consist--.

Signed and Sealed this

Twenty-ninth Day of May, 2001

Nicholas P. Godici

*Attest:*

NICHOLAS P. GODICI

*Attesting Officer*

*Acting Director of the United States Patent and Trademark Office*